United States Patent [19]

Ober

[11] Patent Number: 4,951,882

[45] Date of Patent: Aug. 28, 1990

[54] COMBINATION LEAF AND LAWN DEBRIS COMMINUTING VACUUM AND WOOD CHIPPER

[76] Inventor: Howard R. Ober, 17421 River Rd., Chagrin Falls, Ohio 44022

[21] Appl. No.: 385,945

[22] Filed: Jul. 25, 1989

Related U.S. Application Data

[63] Continuation-in-part of Ser. No. 326,630, Mar. 21, 1989, abandoned.

[51] Int. Cl.[5] ..... B02C 13/04

[52] U.S. Cl. ..... 241/55; 241/92; 241/100; 241/101.7; 241/152 A; 241/154; 241/190

[58] Field of Search ..... 241/152 R, 92, 282.1, 241/224, 282.2, 243, 101.7, 190, 101 D, 55, 189 R, 56, 73, 100, 101.4, 154

[56] References Cited

U.S. PATENT DOCUMENTS

| | | | |
|---|---|---|---|
| 2,658,318 | 11/1953 | Miller . | |
| 3,049,857 | 8/1962 | Shaw . | |
| 3,384,311 | 5/1968 | Eklund et al. . | |
| 3,463,406 | 8/1969 | Musgrave | 241/190 X |
| 3,688,479 | 9/1972 | Martinson et al. . | |
| 3,712,353 | 1/1973 | Ferry . | |
| 3,817,462 | 6/1974 | Hamlin | 241/101.7 |
| 3,907,216 | 9/1975 | Mackissic et al. | 241/101.7 X |
| 3,968,938 | 7/1976 | Ruhl et al. | 241/101.7 X |
| 4,117,983 | 10/1978 | Browning | 241/101.7 X |
| 4,325,163 | 4/1982 | Mattson et al. . | |
| 4,360,166 | 11/1982 | Biersnck | 241/101.7 X |
| 4,753,395 | 6/1988 | Paugh | 241/190 X |
| 4,834,302 | 5/1989 | Baker | 241/101.7 X |

*Primary Examiner*—Mark Rosenbaum
*Attorney, Agent, or Firm*—Michael H. Minns

[57] ABSTRACT

A multipurpose reducer vacuum for vacuuming leaf, garden and lawn debris which uses circular grate bars and free swinging hammers to comminute the debris. The reducer vacuum mounts to the rear bumper of a pickup truck. An adjustable discharge chute is used to direct the comminuted debris into the bed of the pickup truck. A wood chipper is provided on the back side of the apparatus for chipping small limb and branches. An alternate configuration adds an intake hopper which uses a baffle plate in cooperation with cutting bars to pull small limbs, branches and saplings into the reducer vacuum. Feed rates up to one foot per second can be achieved.

35 Claims, 4 Drawing Sheets

COMBINATION LEAF AND LAWN DEBRIS COMMINUTING VACUUM AND WOOD CHIPPER

This application is a continuation-in-part of application Ser. No. 326,630, filed Mar. 21, 1989, now abandoned.

FIELD OF INVENTION

This invention relates to leaf, lawn and garden debris disposal. More particularly, it relates to a multipurpose apparatus that fulfills the requirements of three separate machines, a lawn vacuum, a debris comminutor and a wood chipper.

BACKGROUND OF THE INVENTION

The problem of leaf disposal has changed over the past several decades. Previously, leaves and other organic lawn and garden debris such as tree limbs and branches were raked by hand, collected and burned in an open pile. As concerns over clean air increased, open burning of lawn and garden debris was banned.

Leaf, garden and lawn debris was then collected in piles and allowed to decompose or was hauled or taken to landfills for burying. Decomposition of intact leaves is slow and may take several years before the material has completely decayed. For the last few decades, the burial of leaves and lawn debris has been an effective disposal method. In recent years, as environmental concerns about landfills has increased, the cost of burying trash, garbage, and debris has escalated. The availability of landfills has become limited. Landfill disposal rates have been increasing. In some areas, local disposal costs have increased from $3 to $5 a load to $28 to $35 a load.

Many devices have been created to deal with the problem of leaf, garden and lawn debris. Several are vacuum and pulverizing devices such as U.S. Pat. Nos. 2,658,318, 3,049,857, 3,688,479 and 3,712,353. Others are only vacuums such as U.S. Pat. No. 4,325,163 or are only wood or limb chippers, U.S. Pat. No. 3,384,311. None of these prior art devices have vacuumed up the leaf, garden and lawn debris, shredded the leaves and also chipped the lawn debris such as limbs and branches.

SUMMARY OF THE INVENTION

The present invention is a multipurpose machine that will vacuum leaf, garden and lawn debris, shred the leaf, garden and lawn debris and chip limbs and branches.

The preferred embodiment of the present invention is a gasoline engine driven device that mounts to the bumper of a pickup truck. All of the operative components of the vacuum, reducer, chipper apparatus are mounted on one flywheel. A plurality of fan blades are located around the periphery of the flywheel. These fan blades provide the suction to vacuum leaf, garden and lawn debris through a vacuum hose into a reducing chamber.

Volume reduction is accomplished by a plurality of free swinging hammer bars which extend into a plurality of circular grate bars. The leaf, garden and lawn debris must pass through the circular grate bars where it is comminuted by the free swinging hammers. After being comminuted, the pulverized leaf, garden and lawn debris is blown out a discharge chute and into the bed of the pickup truck.

A chipping blade is located on the reverse side of the flywheel in conjunction with a guide chute on the rear of the housing. Limbs and branches (up to three inches in diameter) which are too large to be vacuumed into the reducing chamber can be manually reduced to chips using the chipping blade. The wood chips enter the exhaust chamber where the fan blades cause them to be expelled into the bed of the pickup truck.

The reducer vacuum achieves a volume reduction of about 75%. This can eliminate three of every four trips to a landfill. Not only does the owner save money with reduced disposal fees, the volume of leaf, garden and lawn debris being disposed is less which reduces the demand on the landfills. Rather than dispose of the reduced debris by landfill burying, the reduced debris can be used as mulch and wood chips. This converts a waste product into a valuable resource.

An alternate configuration adds a feeder intake chute which is designed to pull small limbs, branches and saplings into the reducing chamber. The shape and length of the small limbs, branches and saplings prevent them from being vacuumed through a vacuum hose.

The intake chute has two major components inside the chute. A baffle plate is located just before two rotating blades. The baffle plate prevents the incoming material from rotating when grabbed by the two rotating blades. These rotating blades grab the incoming material and move it into the reduced vacuum.

DETAILED DESCRIPTION OF THE INVENTION

Figure 1:
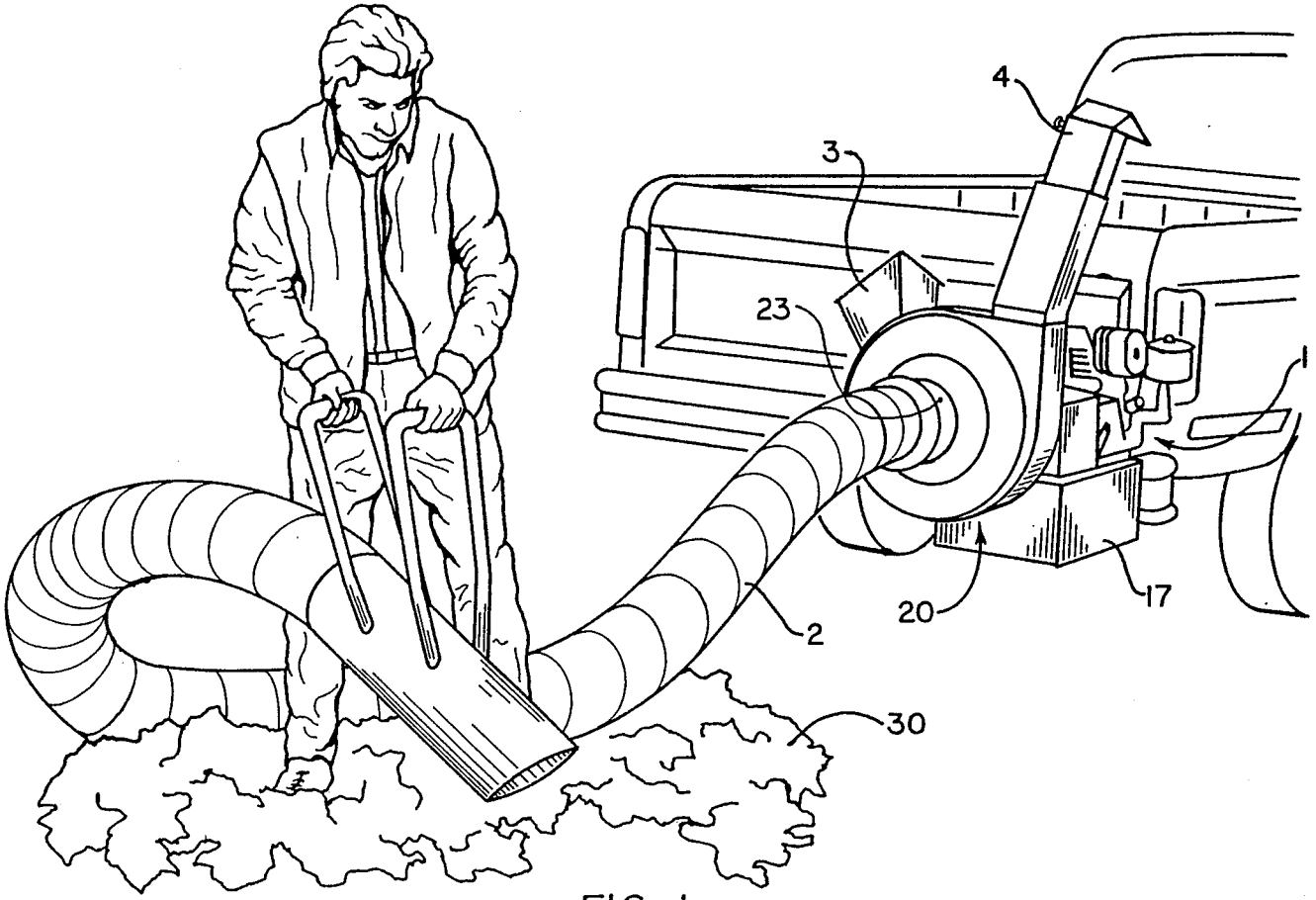
FIG. 1 is a perspective of the preferred embodiment of the present invention showing the apparatus attached to a pickup truck.

FIG. 1 shows the preferred embodiment of the comminuting vacuum and wood chipper or reducer vacuum 20. The reducer vacuum 20 is shown mounted to the rear bumper of a pickup truck.

Figure 2:
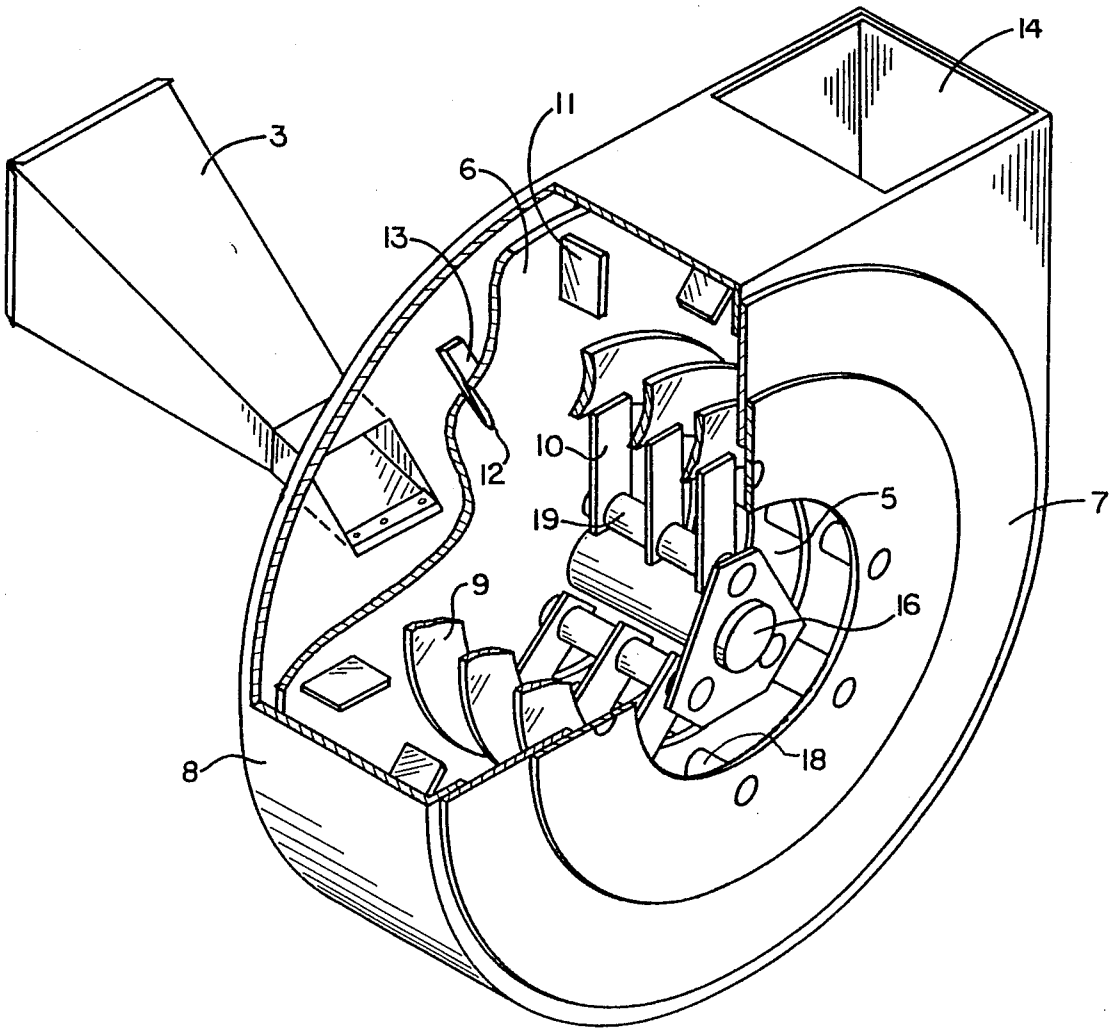
FIG. 2 is a perspective view of the present invention without its engine, vacuum hose or mounting brackets with a partial cutaway of the exterior housing.

A conventional internal combustion engine 1 provides power to the reducer vacuum 20. Typically, a five to eleven horsepower gasoline engine is used. Referring to FIG. 2, the power of the engine 1 is applied through a series of pulleys and belts (not shown) to a main shaft 16. The main shaft 16 is connected to a flywheel or disk 6 which has a slot 12 for wood chips and a chipping blade 13 along with a plurality of fan blades 11 mounted to it. The flywheel 6 is enclosed by a housing 8 and a reducing chamber cover 7. The flywheel 6 is mounted on the shaft 16 so that a small space exists (about one inch) between the back wall of the flywheel 6 and the back wall of the enclosure 8.

A plurality of free swinging hammers 10 are attached to the shaft 16 and the flywheel 6. Spacers 19 are provided to maintain the free swinging hammers 10 parallel to the flywheel 6.

A plurality of circular grate bars 9 are attached to the cover 7. The circular grate bars 9 are spaced apart by a series of spacers 18 such that the circular grate bars 9 are maintained parallel to the cover 7, flywheel 6 and the free swinging hammers 10. The ends of the free swinging hammers 10 extend into the circular grate bars 9. The spacers 18 and spacers 19 are sized and placed so that the free swinging hammers 10 can rotate between the circular grate bars 9 without impacting the bars 9 or spacers 18. This area, which contains the free swinging hammers 10 and the circular grate bars 9, is the reducing chamber 5.

A vacuum hose 2 is connected to an inlet housing 23 on the reducer vacuum 20.

When the reducer vacuum 20 is operated, the fan blades 11 exhaust the air from inside the housing 8 through an exhaust outlet 14 and into a discharge chute 4. The discharge chute 4 can be positioned so that the reduced leaves and wood chips can be directed to all parts of the pickup truck bed. The exhausting of the air causes a vacuum or suction in the reducing chamber 5. The resulting vacuum is sufficient to vacuum leaves and other lawn debris 30 through the vacuum hose 2 into the reducing chamber 5. The vacuum caused by the fan blades 11 pulls the reduced debris through the circular grate bars 9 and increases the rate at which leaf, garden and lawn debris 30 can be processed.

Any leaf, garden and lawn debris 30 that enters the reducing chamber 5 must pass through the circular grate bars 9 in order to be exhausted out of the vacuum reducer 20. As the leaf, garden and lawn debris 30 passes through the circular grate bars 9, the free swinging hammers 10 impact the leaf, garden and lawn debris 30 against the bars 9 and reduce the debris to small particles. Typically, leaf, garden and lawn debris 30 is reduced to particles which will pass through a one-half inch to three-quarters inch screen.

The free swinging hammers 10 extend into the circular grate bars 9 in order to improve the efficiency of the leaf, garden and lawn debris reduction. This extension of the hammers 10 also helps prevent the leaf, garden and lawn debris 30 from building up in layers on the inner radius of the circular grate bars 9. In the event the leaf, garden and lawn debris 30 builds up on the bars 9, vacuum decreases until it is no longer sufficient to suction up leaf, garden and lawn debris 30. At this point, the machine would be shut down and the circular grate bars 9 manually cleaned. Extending the hammer bars 10 into the circular grate bars 9 prevents this buildup.

Sometimes small twigs, bark and even metal objects such as soft drink cans will be vacuumed into the reducing chamber 5. If the object is larger than the gap between the circular grate bars 9, it can become stuck on the bars. If the hammers 10 were rigidly fixed to the shaft 16 of flywheel 6, the hammers 10 could become stuck with the debris and stall the vacuum reducer 20 and the engine 1. Since the hammers 10 are free swinging, they will impact a stuck object and swing back in order to pass by the stuck object. Repeated impacts against such a stuck object will eventually reduce its size until it can pass through the circular grate bars 9 (for most objects including twigs, bark, metal cans, pine cones, etc.). Some objects, such as stones will not be reduced. However, the free swinging hammers 10 will swing back and pass over the object rather than stalling the vacuum reducer 20 and the engine 1.

Because some of the leaf, garden and lawn debris 30 will consist of stones and metal objects, the free swinging hammers 10 are hardened steel in order to resist damage when impacting hard objects. The free swinging hammers 10 are designed to facilitate replacement in the event a hammer is damaged.

After the lawn and leaf debris 30 is reduced, it passes through the circular grate bars 9 into the fan area of the reducer vacuum 20. The fan blades 11 exhaust the reduced debris through the exhaust outlet 14 and into the discharge chute 4. The discharge chute 4 is adjustable so that the discharge can be directed to all parts of the bed of the pickup truck in order to evenly and completely fill the truck without manually redistributing the reduced debris.

In addition to vacuuming and reducing lawn and leaf debris, the reducer vacuum 20 will chip small limbs and branches. A chipping blade 13 is located on the reverse side of the flywheel 6. Limbs and branches up to three inches in diameter can be fed to the chipping blade 13 through a limb chute 3 which is located on the back side of the housing 8. The limb chute 3 and the chipping blade 13 are located on the backside of the flywheel 6 so that the chips from the limbs and branches can pass through a slot 12 in the flywheel 6 and into the main chamber inside the housing 8 where the chips are exhausted along with the reduced debris through exhaust outlet 14.

The flow of air out through the exhaust outlet 14 will cause a slight reduction in pressure and a small flow of air from the region between the flywheel 6 and the back wall of the housing 8. This slight air flow will sweep out any wood chips that do not pass through slot 12 and prevent a build up chips and other debris behind the flywheel 6. Keeping the distance between the flywheel 6 and the back wall of the housing 8 small will facilitate this effect.

The mounting bracket 17 permits the reducer vacuum 20 to be swung away from the tail gate of the pickup truck. To provide easier access to the limb chute 3, the reducer vacuum 20 is swung out to 45°. The reducer vacuum 20 also swings out 90° so that the apparatus is clear from the pickup truck in order to allow the tail gate to be opened in the conventional manner.

Figure 4:
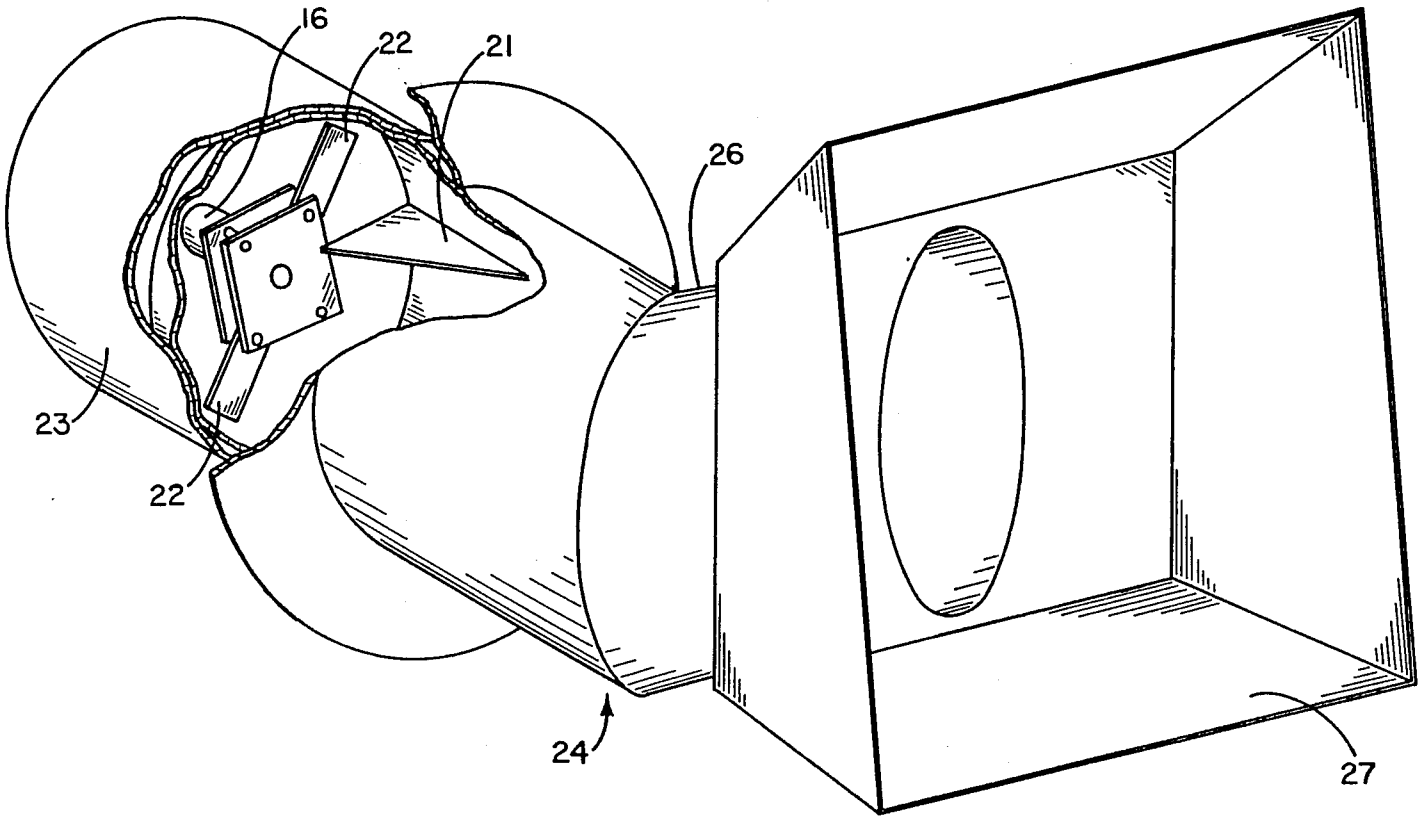
FIG. 4 is a perspective view of the feeder intake chute with a partial cutaway of the exterior housing.

The reducer vacuum 20 can be used with a loading hopper or a vacuum snout in place of the vacuum hose 2. The loading hopper can be of conventional design (not shown) or it can be a feeder intake chute 24 as shown in FIG. 4. It can be mounted on a trailer frame for towing rather than directly to the truck. The reducer vacuum 20 can be mounted on wheels with a vacuum snout and a bag or container for collecting the reduced debris.

The reducer vacuum 20 can also be used for shredding and blowing straw to cover newly planted lawns. It can also spread various types of mulches. If used when cleaning horse stalls, a mix of straw and horse manure is produced which can be used as an organic fertilizer.

Figure 3:
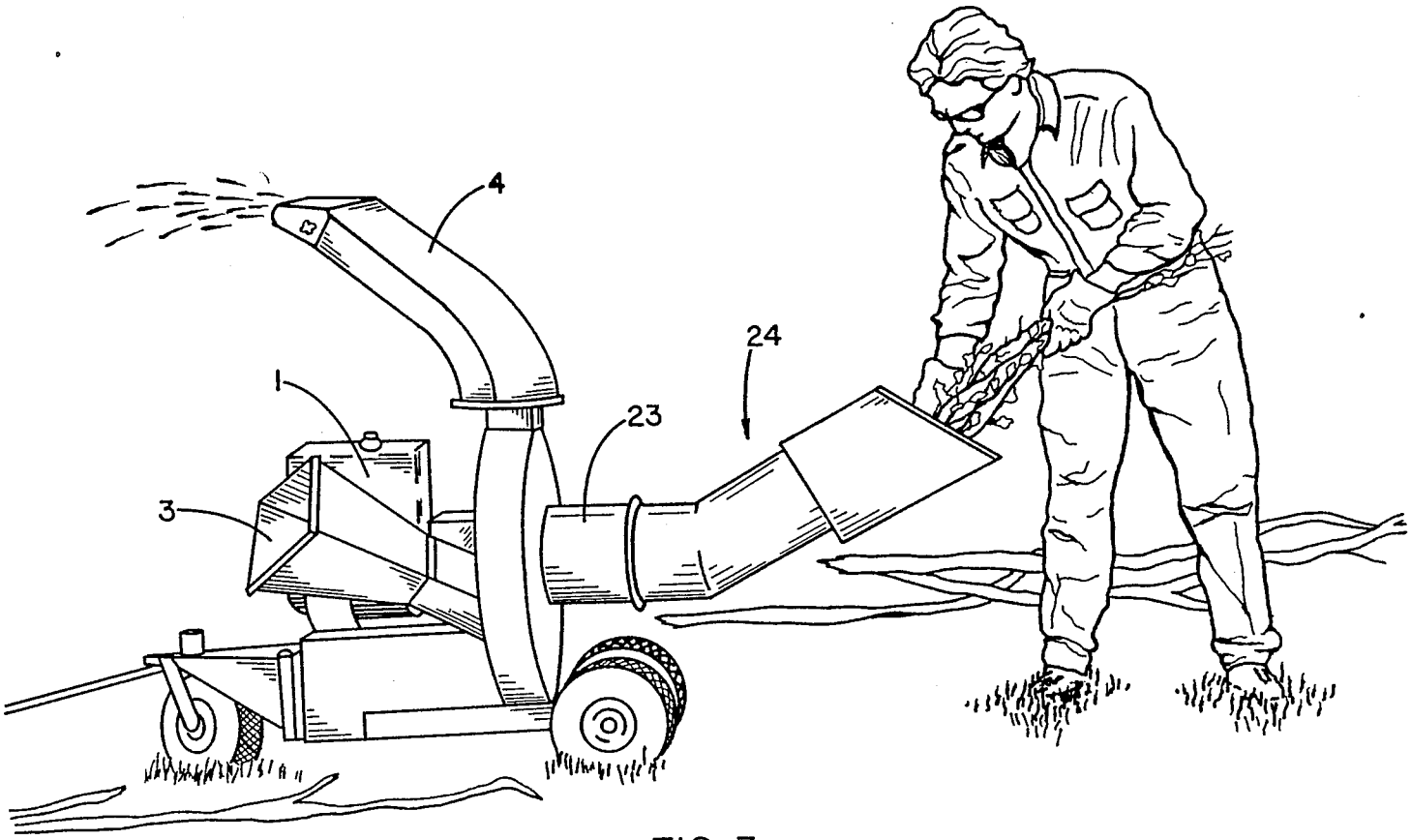
FIG. 3 is a perspective view of the reducer vacuum mounted on wheels with the feeder intake chute attached.

An alternate configuration of the reducer vacuum, shown in FIGS. 3 and 4, adds a feeder intake chute 24 which is designed to pull small limbs, branches and saplings into the reducing chamber 5. The feeder intake chute 24 attaches to the inlet housing 23 in place of a vacuum hose 2 or a vacuum snout (not shown). The feeder intake chute 24 can be used with the pickup truck configuration shown in FIG. 1, or the trailer mounted configuration as shown in FIG. 3.

A feeder intake chute 24 used with the reducer vacuum 20 can achieve material feed rates in excess of one foot per second.

The feeder intake chute 24 is a conventional loading hopper with internal cutting blades 22 and an internal baffle plate 21. The feeder intake chute 24 consists of an inlet hopper 27 and a feeder intake chute housing 26. The feeder intake housing 24 length and shape is designed to prevent the operator's hand and arm from reaching any rotating components.

The cutting blades 22 are free swinging hardened steel blades which are attached to the shaft 16. Attached to the inside circumference of the feeder intake chute housing 26 is a baffle plate 21. The baffle plate 21 extends away from the housing wall at an 80° angle. The baffle plate 21 is angled towards the rotating cutting blades 22. The trailing edge of the baffle plate 21 is approximately 0.75 inches from the cutting blades 22.

If the baffle plate 21 is located closer to the cutting blades 22, the feed material, small limbs, branches and saplings, is cut with very little vibration, but with a decrease in pulling rate. If the baffle plate 21 is located further from the cutting blades 22, the feed material is pulled into the cutting blades 22 at a faster rate, but with greater vibration.

When the feed material is pushed past the baffle plate 21 and into the region of the cutting blades 22, the rotating cutting blades impinge on the feed material, grabbing the material, and pulling it into the feeder intake chute 24. The cutting blades 22 also cut the feed material into pieces two to three inches long. The vacuum in the reducing chamber 5 then pulls these pieces into the reducing chamber where the free swinging hammers 10 and circular grate bars 9 will comminute the pieces into small fragments. The majority of the volume reduction takes place in the reducing chamber 5 and not in the feeder intake chute 24.

The baffle plate 21 also prevents the feed material from rotating when the rotating cutting blades 22 impact the feed material. If the material rotated, no or very little cutting would occur. The feed material would bunch up rather than be vacuumed into the reducing chamber 5.

The feeder intake chute 24 can be used with conventional reducing machines or conventional lawn and garden debris vacuum machines. The cutting blades 22 could be directly mounted to the reducing machine or vacuum machine main shaft where possible. In some cases, an auxiliary shaft (not shown) would be needed and would be driven by belts or gears from the machine's engine.

The feeder intake chamber 24 with the reducer vacuum 20 reduces small limbs, branches and saplings faster than a reducer vacuum 20 can when the limb chute 3 is used. Additionally, the efficiency of the reducer vacuum 20 is increased because the small limbs, branches and saplings are fed into the reducing chamber 5 in large quantities of pieces two to three inches long, rather than being chipped by the chipping blade 3 one or two limbs or saplings at a time.

Basically, the prior art devices rely on vacuum or manual feeding to pull material into the machine. The Martison device, U.S. Pat. No. 3,688,479, uses a rotating brush to sweep material into the suction of the device. None of the feed mechanisms in these prior art vacuums or comminutors will pull small limbs, branches and saplings into the machines.

I claim:

1. A reducing vacuum machine comprising:

(a) a housing including a cylindrical wall, a first end wall and a second end wall, a first inlet opening in said first end wall and an outlet opening in said cylindrical wall;

(b) a suction hose connected with said first inlet opening;

(c) a disc revolvably mounted in said housing including a plurality of fan blades affixed to said disc;

(d) a power means for rotating said disc, said power means mounted adjacent to said housing;

(e) a plurality of circular bars mounted to said first end wall encircling said first inlet opening, said bars being in parallel spaced relationship to said first end wall;

(f) a plurality of hammers pivotally connected to said disc, the outer end of said hammers being disposed closely adjacent to said circular bars, said hammers being in parallel spaced relationship to said first end wall; and (g) a discharge chute mounted to said outlet opening.

2. The reducing vacuum machine as defined in claim 1 wherein the outer end of said hammers extends into the space between adjacent circular bars.

3. The reducing vacuum machine as defined in claim 1 further comprising a mounting means wherein said machine can be swingably mounted to the rear bumper of a pickup truck.

4. The reducing vacuum machine as defined in claim 1 further comprising:

(a) a second inlet opening in said second end wall;

(b) a slot located on said disc in spaced relationship with said second inlet opening; and (c) a blade located on said disc adjacent to said slot wherein said blade chips limbs and branches.

5. The reducing vacuum as defined in claim 4 wherein the space between said disc and said second end wall does not exceed one inch.

6. The reducing vacuum machine as defined in claim 1 wherein a debris loading hopper is connected to said first inlet opening.

7. The reducing vacuum machine as defined in claim 1 and a chassis for supporting said machine, wheels attached to said chassis and a handle on said chassis to facilitate movement of the chassis along the surface of the ground.

8. The reducing vacuum machine as defined in claim 7 wherein a vacuum snout is connected to said first inlet opening.

9. The reducing vacuum machine as defined in claim 7 wherein a collection bag is attached to said outlet opening.

10. The reducing vacuum machine as defined in claim 1 wherein a feed mechanism is connected to said first inlet opening, said feed mechanism comprising:

(a) a second housing;

(b) a shaft connected to said disk;

(c) a plurality of cutting bars pivotally mounted to said shaft; and (d) at least one baffle plate mounted to an inside surface of said second housing, said baffle plate being located before said cutting bars wherein said baffle plate cooperates with said cutting bars to pull feed material into said reducing vacuum machine.

11. The apparatus as defined in claim 10 wherein the trailing edge of said baffle plate is located 0.5 inches to 1.0 inches from said catting base.

12. The apparatus as defined in claim 1 wherein the trailing edge of said baffle plate is located 0.5 inches to 1.0 inches from said cutting bars.

13. A reducing vacuum machine comprising:

(a) a housing including a cylindrical wall, a first end wall and a second end wall, a first inlet opening in said first end wall and an outlet opening in said cylindrical wall;

(b) a suction hose connected with said first inlet opening;

(c) a disc revolvably mounted in said housing including a plurality of fan blades affixed to said disc;

(d) a power means for rotating said disc, said power means mounted adjacent to said housing;

(e) a plurality of circular bars mounted to said first end wall encircling said first inlet opening, said bars being in parallel spaced relationship to said first end wall;

(f) a plurality of hammers pivotally connected to said disc, the outer end of said hammers extending into the space between adjacent circular bars, said hammers being in parallel spaced relationship to said first end wall; and (g) a discharge chute mounted to said outlet opening.

14. The reducing vacuum machine as defined in claim 13 further comprising:

(a) a second inlet opening in said second end wall;

(b) a slot located on said disc in spaced relationship with said second inlet opening; and (c) a blade located on said disc adjacent to said slot wherein said blade chips limbs and branches.

15. The reducing vacuum as defined in claim 14 wherein the space between said disc and said second end wall does not exceed one inch.

16. The reducing vacuum machine as defined in claim 13 further comprising a mounting means wherein said machine can be swingably mounted to the rear bumper of a pickup truck.

17. The reducing vacuum machine as defined in claim 13 and a chassis for supporting said machine, wheels attached to said chassis and a handle on said chassis to facilitate movement of the chassis along the surface of the ground.

18. The reducing vacuum machine as defined in claim 17 wherein a vacuum snout is connected to said first inlet opening.

19. The reducing vacuum machine as defined in claim 17 wherein a collection bag is attached to said outlet opening.

20. The reducing vacuum machine as defined in claim 13 wherein a feed mechanism is connected to said first inlet opening, said feed mechanism comprising:

(a) a second housing;

(b) a shaft connected to said disk;

(c) a plurality of cutting bars pivotally mounted to said shaft; and (d) at least one baffle plate mounted to an inside surface of said second housing, said baffle plate being located before said cutting bars wherein said baffle plate cooperates with said cutting bars to pull feed material into said reducing vacuum machine.

21. The apparatus as defined in claim 10 wherein the trailing edge of said baffle plate is located 0.5 inches to 1.0 inches from said cutting bars.

22. A reducing vacuum machine comprising:

(a) a housing including a cylindrical wall, a first end wall and a second end wall, a first inlet opening in said first end wall, a second inlet opening in said second end wall and an outlet opening in said cylindrical wall;

(b) a suction hose connected with said first inlet opening;

(c) a flywheel revolvably mounted in said housing including a plurality of fan blades affixed to said flywheel, a slot located on said flywheel in spaced relationship with said second inlet opening and a blade located on said flywheel adjacent to said slot wherein said blade chips limbs and branches;

(d) a power means for rotating said flywheel, said power means mounted adjacent to said housing;

(e) a plurality of circular bars mounted to said first end wall encircling said first inlet opening, said bars being in parallel spaced relationship to said first end wall;

(f) a plurality of hammers pivotally connected to said flywheel, the outer end of said hammers extending into the space between adjacent circular bars, said hammers being in parallel spaced relationship to said first end wall; and (g) a discharge chute mounted to said outlet opening.

23. The reducing vacuum as defined in claim 22 wherein the space between said flywheel and said second end wall does not exceed one inch.

24. The reducing vacuum machine as defined in claim 22 wherein a debris loading hopper is connected to said first inlet opening.

25. The reducing vacuum machine as defined in claim 22 further comprising a mounting means wherein said machine can be swingably mounted to the rear bumper of a pickup truck.

26. The reducing vacuum machine as defined in claim 22 and a chassis for supporting said machine, wheels attached to said chassis and a handle on said chassis to facilitate movement of the chassis along the surface of the ground.

27. The reducing vacuum machine as defined in claim 26 wherein a vacuum snout is connected to said first inlet opening.

28. The reducing vacuum machine as defined in claim 26 wherein a collection bag is attached to said outlet opening.

29. The reducing vacuum machine as defined in claim 22 wherein a feed mechanism is connected to said first inlet opening, said feed mechanism comprising:

(a) a second housing;

(b) a shaft connected to said disk;

(c) a plurality of cutting bars pivotally mounted to said shaft; and (d) at leat one baffle plate mounted to an inside surface of said second housing, said baffle plate being located before said cutting bars wherein said baffle plate cooperates with said cutting bars to pull feed material into said reducing vacuum machine.

30. A feeding apparatus in combination with a comminuting machine, comprising:

(a) a comminuting machine having a power source;

(b) a housing connected to said cominating machine;

(c) a shaft revolvably mounted in said housing, said shaft aligned such that the axis of rotation is horizontal;

(d) a plurality of cutting bars pivotally mounted to said shaft;

(e) a transmission means connecting said shaft to said power source on said comminuting machine; and (f) at least one baffle plate mounted to an inside surface of said housing, said baffle plate being located before said cutting bars wherein said baffle plate cooperates with said cutting bars to pull feed material into said comminuting machine.

31. A feeding apparatus as in claim 30 wherein said cutting bars are parallel to a trailing edge of said baffle plate.

32. A feeding apparatus as in claim 30 wherein said cutting bars are at a right angle to the direction that the feed material is being fed into said housing.

33. A feeding apparatus as in claim 30 wherein a trailing edge of said baffle plate is located 0.5 to 1.0 inches from said cutting bars.

34. A feeding apparatus as in claim 30 wherein said shaft is directly connected to a shaft on said comminuting machine.

35. A feeding apparatus as in claim 30 wherein said shaft is directly connected to a disc on said comminuting machine.

* * * * *